US008292143B2

(12) United States Patent
Lee et al.

(10) Patent No.: US 8,292,143 B2
(45) Date of Patent: Oct. 23, 2012

(54) DRY FIRE LOCKOUT WITH BYPASS FOR FASTENER DRIVING DEVICE

(75) Inventors: Sean Lee, Dali (TW); Jim Liu, Dali (TW); Benson Liao, Dali (TW)

(73) Assignee: Stanley Fastening Systems, L.P., East Greenwich, RI (US)

( * ) Notice: Subject to any disclaimer, the term of this patent is extended or adjusted under 35 U.S.C. 154(b) by 191 days.

(21) Appl. No.: 12/902,995

(22) Filed: Oct. 12, 2010

(65) Prior Publication Data

US 2012/0085806 A1 Apr. 12, 2012

(51) Int. Cl.
*B25C 1/04* (2006.01)

(52) U.S. Cl. ..... 227/8; 227/120

(58) Field of Classification Search ..... 227/8, 120, 227/130, 142, 109
See application file for complete search history.

(56) References Cited

U.S. PATENT DOCUMENTS

| | | | | |
|---|---|---|---|---|
| 3,198,412 | A | 8/1965 | Roosa | 227/8 |
| 3,606,128 | A | 9/1971 | Cast et al. | 227/1 |
| 3,858,781 | A | 1/1975 | Obergfell et al. | 227/8 |
| 4,197,974 | A | 4/1980 | Morton et al. | 227/8 |
| 4,463,888 | A | 8/1984 | Geist et al. | 227/109 |
| 5,180,091 | A | 1/1993 | Ota | 227/8 |
| 5,593,079 | A | 1/1997 | Mukoyama et al. | 227/8 |
| 5,816,468 | A | 10/1998 | Yang | 227/8 |
| 6,012,622 | A | 1/2000 | Weinger et al. | 227/8 |
| 6,149,046 | A | 11/2000 | Ho et al. | 227/8 |
| 6,199,739 | B1 | 3/2001 | Mukoyama et al. | 227/8 |
| 6,209,770 | B1 * | 4/2001 | Perra | 227/8 |
| 6,264,085 | B1 | 7/2001 | Ho et al. | 227/8 |
| 6,592,014 | B2 | 7/2003 | Smolinski | 227/8 |
| 6,783,044 | B2 | 8/2004 | Perra et al. | 227/8 |
| 6,908,021 | B1 | 6/2005 | Wang | 227/8 |
| 6,913,179 | B1 | 7/2005 | Chen | 227/8 |
| RE38,834 | E | 10/2005 | Perra | 173/8 |
| 6,966,476 | B2 | 11/2005 | Jalbert et al. | 227/8 |
| 6,966,477 | B1 | 11/2005 | Chien-Kuo et al. | 227/8 |
| 6,997,365 | B2 | 2/2006 | Miller et al. | 227/8 |
| 7,021,511 | B2 | 4/2006 | Popovich et al. | 227/8 |
| 7,059,507 | B2 | 6/2006 | Almeras et al. | 227/8 |
| 7,086,573 | B1 | 8/2006 | Wen | 227/8 |
| 7,134,586 | B2 | 11/2006 | McGee et al. | 227/125 |
| 7,150,385 | B1 | 12/2006 | Wen | 227/8 |
| 7,182,236 | B1 | 2/2007 | Wen | 227/8 |
| 7,213,732 | B2 | 5/2007 | Schell et al. | 227/8 |
| 7,303,103 | B2 | 12/2007 | Wang | 227/8 |
| 7,328,826 | B2 | 2/2008 | Shkolnikov | 227/8 |
| 7,413,103 | B1 | 8/2008 | Ho et al. | 227/8 |
| 7,506,787 | B2 * | 3/2009 | Wu et al. | 227/8 |
| 7,766,204 | B2 * | 8/2010 | Spasov et al. | 227/8 |
| 7,922,054 | B2 * | 4/2011 | Cole, Jr. | 227/8 |
| 7,980,439 | B2 * | 7/2011 | Akiba et al. | 227/8 |
| 8,061,437 | B2 * | 11/2011 | Liang | 173/120 |
| 8,104,658 | B2 * | 1/2012 | Yu | 227/8 |
| 2009/0236387 | A1 | 9/2009 | Simonelli et al. | 227/8 |

* cited by examiner

*Primary Examiner* — Scott A. Smith
(74) *Attorney, Agent, or Firm* — Pillsbury Winthrop Shaw Pittman LLP

(57) ABSTRACT

A dry fire lockout assembly for a fastener driving device includes a bypass feature. A link is movably mounted to an upper contact arm and interconnected with a lower contact arm when the link is in a first orientation. The link includes a dry fire lockout portion. A dry fire lockout portion of a lifter is configured to engage the dry fire lockout portion of the link, when a supply of fasteners in the fastener driving device is less than a predetermined number of fasteners, and move the link against the bias of the biasing member to a second orientation in which the link is not interconnected with the lower contact arm.

14 Claims, 15 Drawing Sheets

DRY FIRE LOCKOUT WITH BYPASS FOR FASTENER DRIVING DEVICE

FIELD

The present invention is related to a dry fire lockout with a bypass for a fastener driving device.

BACKGROUND

Actuating a fastener driving device, such as a pneumatic nail gun, without a fastener in the device may leave undesirable driver marks on a work piece. A dry fire lockout is generally designed to prevent a user from accidentally actuating the fastener driving device by preventing a contact safety trip from being actuated when there are no or only a few fasteners remaining in the fastener driving device. Because the contact safety trip typically cannot move when the dry fire lockout is in place, there is a potential to damage the contact safety trip in the event the fastener driving device is accidentally dropped.

SUMMARY

It is desirable to provide a fastener driving device with a dry fire lockout that may be bypassed in the sense that a portion of the contact safety trip may move in the event the device is dropped to protect the contact safety trip, while still preventing accidental actuation of the fastener driving device.

According to one aspect of the invention, there is provided a fastener driving device that includes a housing having an engine receiving portion, and a drive engine located in the engine receiving portion. The drive engine includes a cylinder and a piston reciprocally mounted within the cylinder. The piston includes a driver configured to move along a drive axis to drive a fastener during a drive stroke. A nose assembly is operatively connected to the housing. The nose assembly includes a drive track aligned with the drive axis. A magazine is constructed and arranged to feed successive leading fasteners from a supply of fasteners into the drive track. A pusher assembly includes a pusher configured to push the supply of fasteners towards the drive track, and a lifter that includes a dry fire lockout portion. A trigger is configured to operate the drive engine. The fastener driving device also includes a contact trip assembly that includes a lower contact arm including a first end configured to contact a work piece, and an upper contact arm including a first end operatively connected to the lower contact arm, and a second end configured to enable the trigger to operate the drive engine. The contact trip assembly also includes a link movably mounted to the first end of the upper contact arm and interconnected with the lower contact arm when the link is in a first orientation. The link includes a dry fire lockout portion, and a biasing member positioned between the link and the upper contact arm. The biasing member is configured to bias the link in the first orientation so that the link is interconnected with the lower contact arm to operatively connect the link and the lower contact arm. The dry fire lockout portion of the lifter is configured to engage the dry fire lockout portion of the link, when the supply of fasteners is less than a predetermined number of fasteners, and move the link against the bias of the biasing member to a second orientation in which the link is not interconnected with the lower contact arm.

According to another aspect of the invention, there is provided a dry fire lockout assembly for a fastener driving device. The dry fire lockout assembly includes a lifter that includes a dry fire lockout portion, and a contact trip assembly that includes a lower contact arm comprising a first end configured to contact a work piece, and an upper contact arm including a first end operatively connected to the lower contact arm, and a second end configured to enable a trigger to operate a drive engine of the fastener driving device. The contact trip assembly also includes a link movably mounted to the first end of the upper contact arm and interconnected with the lower contact arm when the link is in a first orientation. The link includes a dry fire lockout portion. The contact trip assembly also includes a biasing member positioned between the link and the upper contact arm. The biasing member is configured to bias the link in the first orientation so that the link is interconnected with the lower contact arm to operatively connect the link and the lower contact arm. The dry fire lockout portion of the lifter is configured to engage the dry fire lockout portion of the link, when a supply of fasteners in a magazine of the fastener driving device is less than a predetermined number of fasteners, and move the link against the bias of the biasing member to a second orientation in which the link is not interconnected with the lower contact arm.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

Features of the fastener driving device in accordance with one embodiment are shown in the drawings, in which like reference numerals designate like elements. The drawings form part of this original disclosure in which.

DETAILED DESCRIPTION

Figure 1:
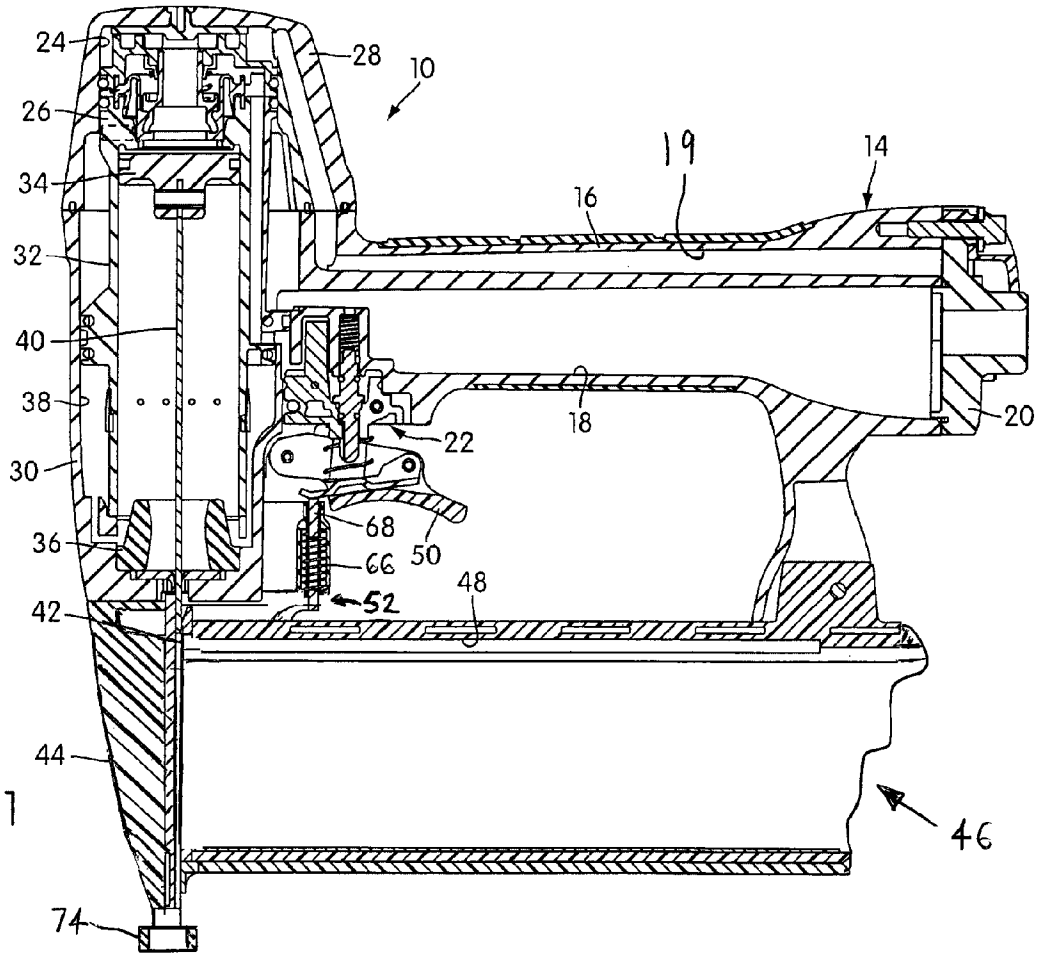
FIG. 1 illustrates a cross-sectional view of a fastener driving device according to an embodiment of the invention.

Referring now more particularly to the drawings, there is shown in FIG. 1 a fastener driving device, generally indicated at 10, in accordance with an embodiment of the invention. The fastener driving device 10 itself may be of any known configuration. As shown, the fastener driving device 10 is power operated. Such power operation can be of any well known type such as electrical, internal combustion or pneumatic. The fastener driving device 10 as shown in FIG. 1 is a typical pneumatically powered unit.

Specifically, the pneumatically powered fastener driving device 10 shown in FIG. 1 includes a portable housing or frame assembly, generally indicated at 14. The portable housing assembly 14 includes a handle section 16 which is hollow so as to define a pneumatic reservoir 18. A fitting 20 leads to the reservoir 18 enabling a source of air under pressure (not shown) to be communicated with the reservoir 18. As illustrated, the handle section 16 may also define a second reservoir 19 that is open to atmosphere and is configured to allow exhausted gas to exit the fastener driving device 10 after the device has been actuated.

The reservoir 18 communicates with a manually operable trigger valve assembly 22, which controls the communication of the reservoir to a pilot pressure chamber 24 of a main valve assembly 26. The main valve assembly 26 is housed within a cap assembly 28, fixed to the top of a main housing section 30, that is integral with and extending generally perpendicular to the handle section 16, both of which form parts of the portable housing assembly 14.

Mounted within the main housing section 30 is a cylinder 32, an upper end of which cooperates with the main valve assembly 26 to enable the main valve assembly 26 to function in the usual fashion when in an inoperative position, wherein the pilot pressure chamber 24, under the control of trigger valve assembly 22 in its inoperative position, is communicated with the reservoir 18. When in its inoperative position, the main valve assembly 26 also functions to communicate the open upper end of the cylinder 32 with atmosphere through the cap assembly 28.

When the trigger valve assembly 22 is manually moved from its inoperative position into an operative position, the pilot pressure chamber 24 is shut off from communication with the reservoir 18 and communicated with atmosphere. The pressure from the reservoir 18 then acts upon the main valve assembly 26 to move it from its inoperative position into an operative position. In its operative position, the main valve assembly 26 functions to shut off the communication of the open upper end of the cylinder 32 with the atmosphere and to allow full peripheral communication thereof with the reservoir 18.

Communication of the reservoir 18 with the open upper end of the cylinder 32 serves to drive a piston 34 slidably mounted within the cylinder 32 through a fastener drive stroke which is completed when the piston 34 engages a shock absorbing bumper 36 mounted in the main housing section 30 below the lower end of the cylinder 32 which is fixed therein.

The drive stroke of the piston 34 constitutes one stroke of a two stroke cycle of movement that the piston 34 undergoes on a successive basis in accordance with the manual actuating movement of the trigger valve assembly 22. The other stroke of the piston 34, which constitutes a return stroke, is accomplished by a suitable return system 38. The return system can be of any known type. As shown, the return system 38 is of the air plenum chamber type.

The drive stroke of the piston 34 serves to move a fastener driver 40 connected therewith through a drive stroke within a drive track 42 formed within a nose piece assembly 44 fixed below the lower end of the main housing section 30 and forming a part of the portable housing assembly 14. The drive stroke of the fastener driver 40 serves to drive a leading fastener from a supply of fasteners contained within a fastener magazine 46 which has been laterally moved into the drive track 42 along a feed track 48 defined by the magazine 46.

The magazine 46, which is fixed to the nose piece assembly 44 and extends below and is fixed to the handle section 16, can be of any known type. For example, the magazine 46 may be a conventional side loader or a rear loader that is capable of handling fasteners in a stick formation supply, as shown in the Figures, or a coil formation supply of any well known configuration.

The trigger valve assembly 22 is manually actuated by an actuating mechanism which includes a trigger 50 and a contact trip assembly 52. A complete actuation movement serves to move the trigger valve assembly 22 from its inoperative position into its operative position by the coordinated movement of the trigger 50 and contact trip assembly 52. The trigger 50 may be of any conventional construction so as to require any known coordination to effect operation. The contact trip assembly 52 is discussed in greater detail below. In an embodiment, cooperation between the trigger 50 and the contact trip assembly 52 is such that the trigger valve assembly 22 will be moved from its inoperative position into its operative position only when the contact trip assembly 52 is first moved against the work piece and into its operative position and thereafter the trigger 50 is manually moved into its operative position.

In one aspect of the present invention, the device 10 can be adapted to handle any fastener configuration. A pusher assembly 54, which is discussed in greater detail below, is slidably mounted in the feed track 48 of the magazine 46 and is spring-biased to move in a direction toward the drive track 42. As discussed in further detail below, the contact trip assembly 52 and the pusher assembly 54 are part of a dry fire lockout assembly 55, illustrated in FIG. 3.

Figure 2:
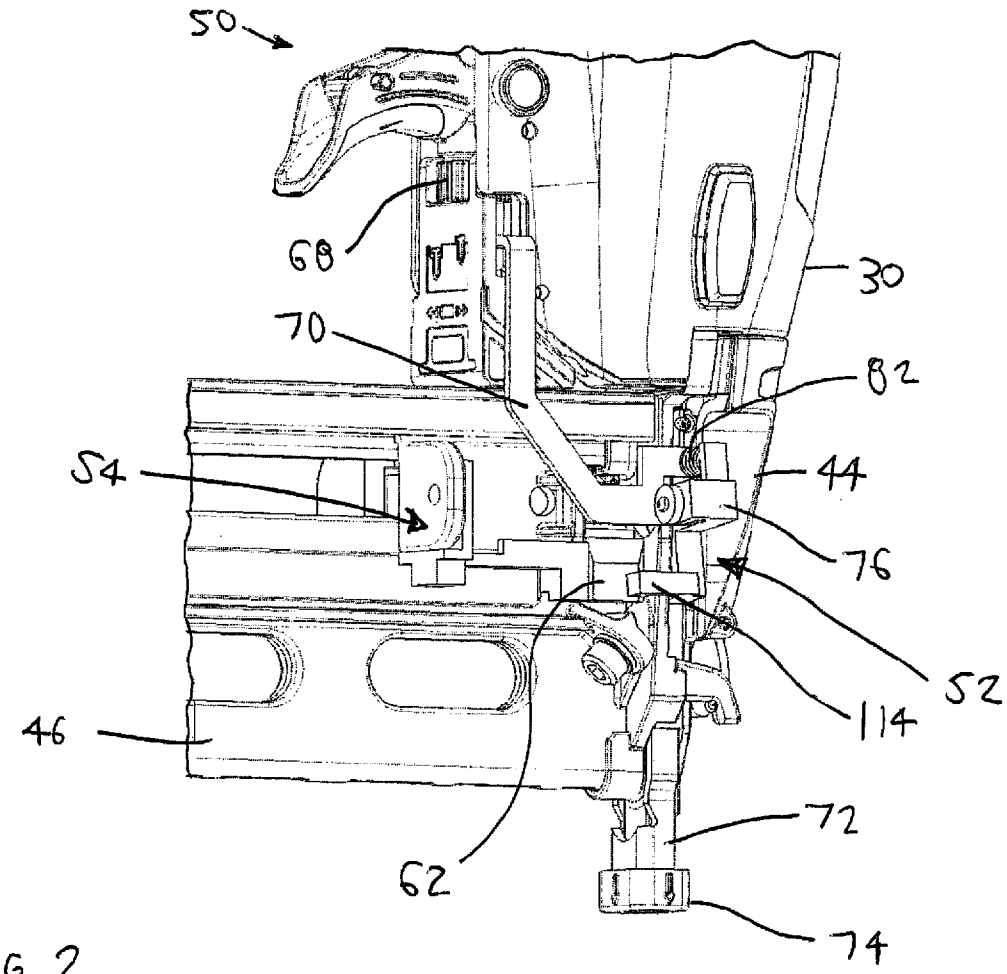
FIG. 2 illustrates a portion of the fastener driving device of FIG. 1 according to an embodiment of the invention.
Figure 3:
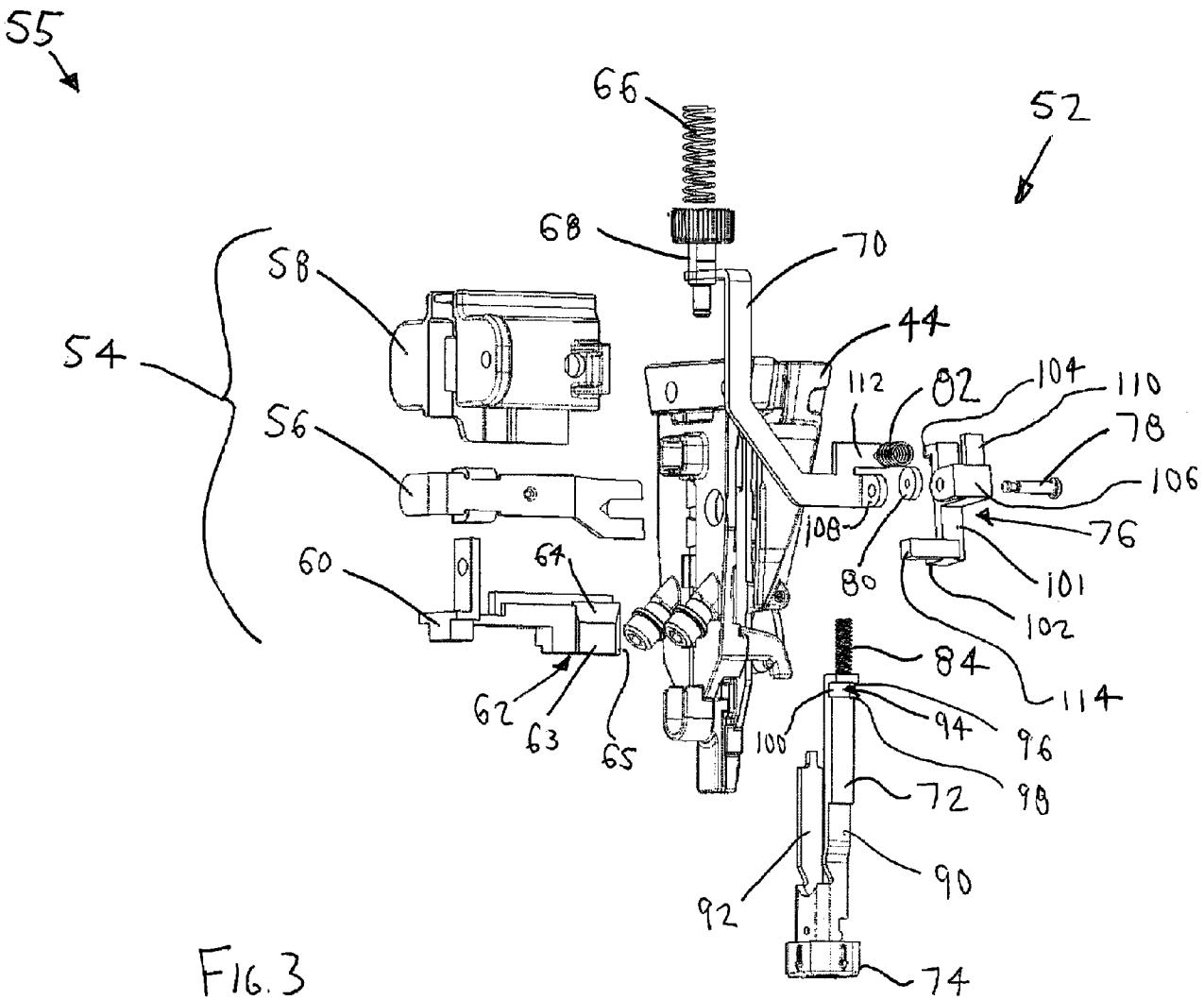
FIG. 3 illustrates an exploded view of a dry fire lockout assembly, which includes a contact trip assembly and a pusher assembly, of the fastener driving device of FIG. 2.

The contact trip assembly 52, in addition to its biasing spring, which is shown at 66 in FIG. 1 and FIG. 3, may be of a non-adjustable construction, however, in the illustrated embodiment, the contact trip assembly 52 provides for adjustment of the depth of penetration of the fastener into the work piece during the drive stroke of the fastener driver 40 via an adjuster 68, illustrated in FIGS. 2 and 3. By rotating the adjuster 68, the rest of the contact trip assembly 52 may be moved relative to the nose piece assembly 44. Moving the contact trip assembly 52 so that the contact trip assembly extends further past the bottom of the nose piece assembly 44 allows for the fastener driver 40 to strike the head of the fastener when the head of the fastener is located at a greater distance from the work piece, which will not drive the fastener as deep into the work piece. Conversely, moving the contact trip assembly 52 so that the contact trip assembly 52 retracts relative to the nose piece assembly 44 allows for the fastener driver 40 to strike the head of the fastener when the head of the fastener is located at a shorter distance from the work piece, which will drive the fastener deeper into the work piece. FIG. 2 illustrates the fastener driving device 10 when the device 10 is in a dry fire lockout condition, which is discussed in further detail below.

Figure 4:
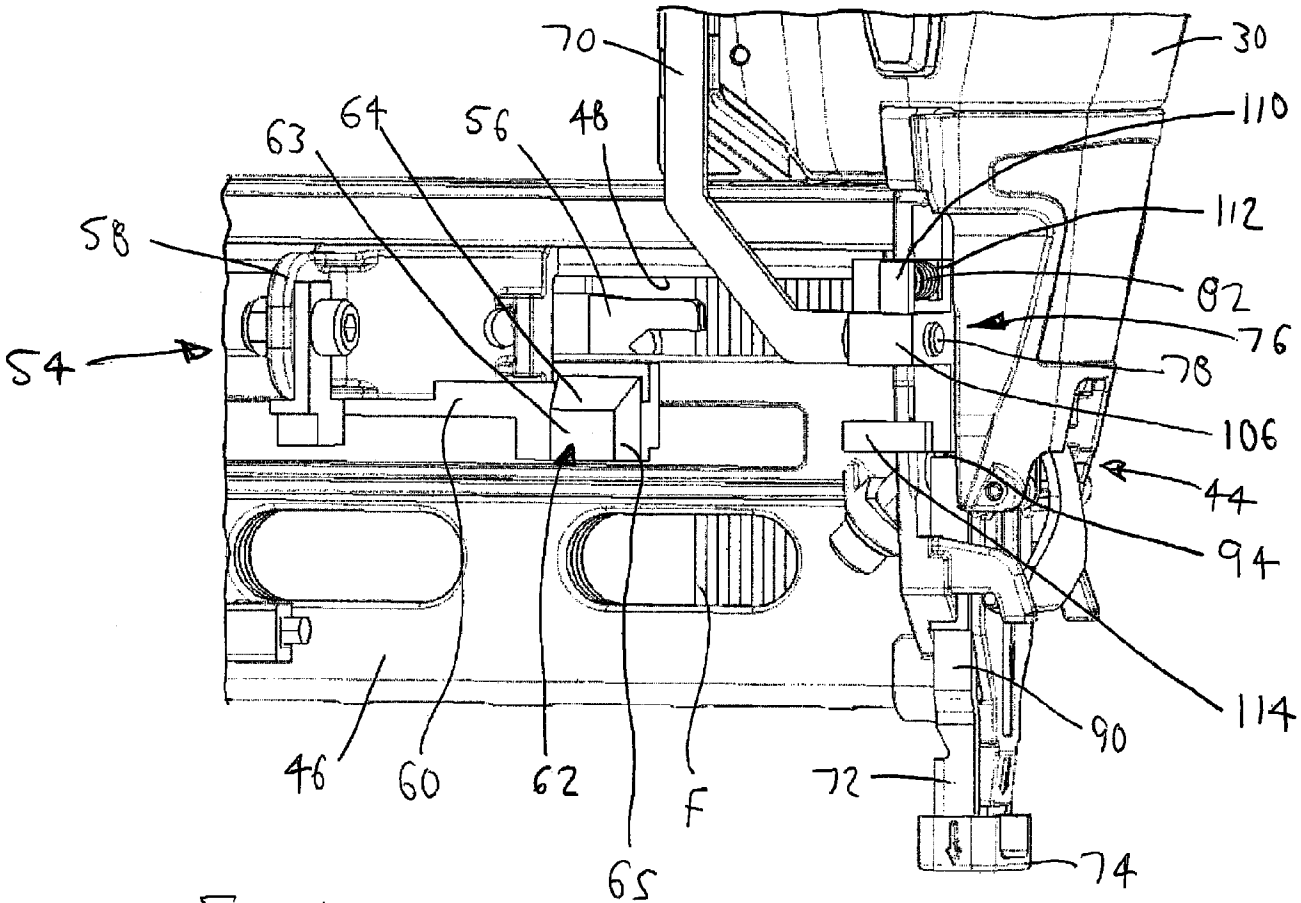
FIG. 4 illustrates the portion of the fastener driving device of FIG. 2 with a supply of fasteners in a magazine.

FIG. 3 illustrates the components of the pusher assembly 54, as well as the contact trip assembly 62, according to one embodiment of the invention. The pusher assembly 54 includes a pusher 56, a pusher guide 58, and a lifter 60. The pusher 56 and the lifter 60 are connected to the pusher guide 58 by any suitable means, such as fasteners, for example. The pusher guide 58 is configured to slide along the feed track 48 of the magazine 46, and is biased by a biasing member (not shown) towards the drive track. The pusher 56 is configured to engage a supply of fasteners F in the feed track 48 of the magazine 46, as illustrated in FIG. 4. The lifter 60 is part of a dry fire lockout device 55 that is discussed in further detail below. As illustrated in FIGS. 3 and 4, the lifter 60 has a dry fire lockout portion 62 that includes a first surface 63, a second surface 64 that is oriented at an angle (i.e. is ramped) with respect to the first surface 63 and generally facing the upper contact arm 70, and a third surface 65 that is oriented at an angle (i.e. is ramped) with respect to the first surface 63 and generally faces the nose piece assembly 44.

As illustrated in FIG. 3, the contact trip assembly 52 generally includes an upper contact arm 70, a lower contact aim 72, and a link 76 that operatively connects the upper contact arm 70 and the lower contact arm 72. The link 76 is pivotally mounted on the upper contact arm 70 by a pin 78 and associated flexible ring 80 that is configured to be received by the pin 78. Any suitable connector may be used to pivotally connect the link 76 to the upper contact arm 70. The illustrated embodiment is not intended to be limiting in any way.

Figure 6:
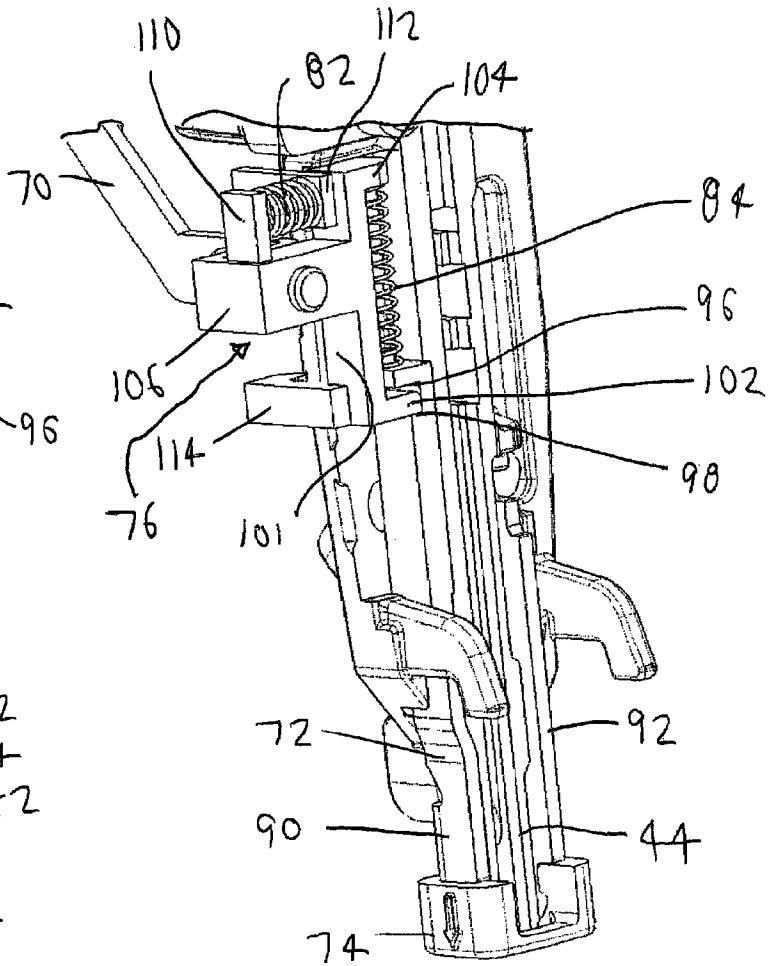
FIG. 6 illustrates the portion of the contact trip assembly of FIG. 5 when the contact trip assembly is in an actuated position by being pressed against a work piece.
Figure 5:
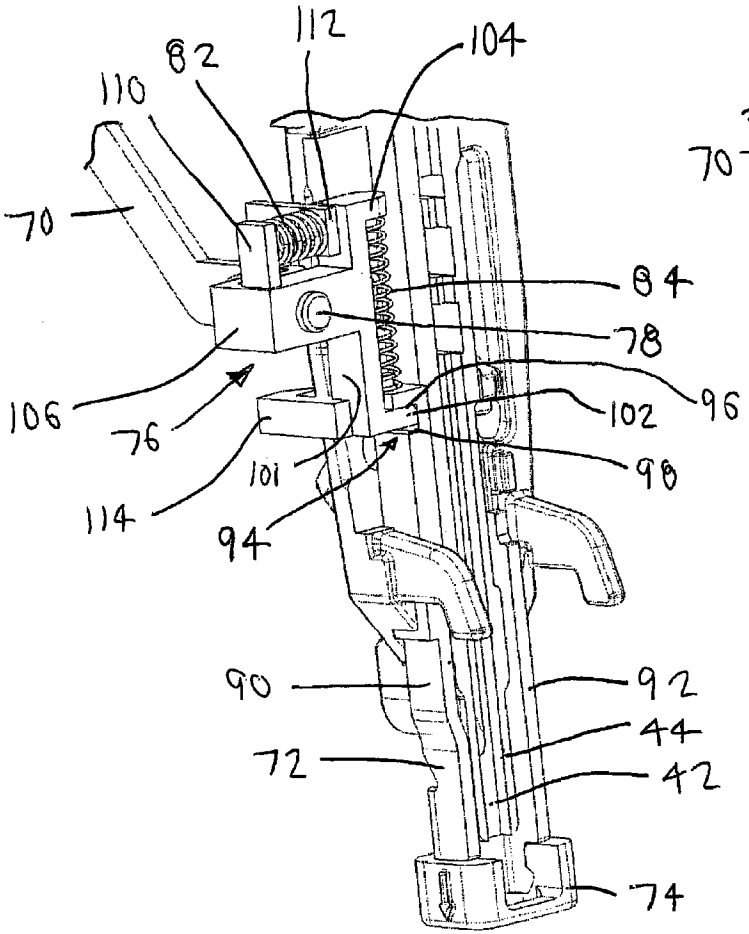
FIG. 5 illustrates a portion of the contact trip assembly of FIG. 3 when the contact trip assembly is in a non-actuated position.

As illustrated in FIGS. 4-6, a biasing member 82, which in the illustrated embodiment is shown to be a coil spring, is positioned between the upper contact arm 70 and a portion of the link 76. In an embodiment, such as the embodiment illustrated in FIGS. 15-19 and discussed below, the biasing member may be a torsion spring. The biasing member 82 is configured to bias the link 76 in a first orientation in which the link 76 is interconnected with the lower contact arm 72 so that the lower contact arm 72 and the upper contact arm 70 are operatively connected, as discussed in further detail below. As shown in FIGS. 5 and 6, a spring 84 is positioned between one end of the lower contact arm 72 and another portion of the link 76. The function of the spring 84 will be discussed in further detail below.

Returning to FIG. 3, a contact trip foot 74, which is mounted to one end of the lower contact arm 72, is configured to engage the work piece. The lower contact arm 72 generally includes a first elongated portion 90 and a second elongated portion 92 that extend upwards from the contact trip foot 74. Although the first elongated portion 90 is illustrated as being longer than the second elongated portion 92, the illustrated embodiment is not intended to be limiting in any way. The second elongated portion 92 is configured to be received by a channel in the nose piece assembly 44 and is configured to provide additional stiffness and stability to the lower contact arm 72 during actuation of the contact trip assembly 52.

In order for the link 76 and the lower contact arm 72 to be interconnected when the link 76 is in the first orientation, the link 76 and the lower contact arm 72 have cooperating interengaging structures that are configured to provide an interconnection when the link 76 is in the first orientation, and to not provide an interconnection when the link 76 is moved to a second orientation against the bias of the biasing member 82. In an embodiment, as part of the interengaging structure for the lower contact arm 72, the first elongated portion 90 of the lower contact arm 72 includes a recess 94 near an end that is opposite the contact trip foot 74. The recess 94 is generally defined by three surfaces, including a portion of a first surface 96, a second surface 98 that is substantially parallel to the first surface 96, and a third surface 100 that is substantially perpendicular to and connects the first surface 96 and the second surface 98.

The link 76 includes an elongated main body portion 101 that includes a first protrusion 102 that extends substantially perpendicularly from one end of the main body portion 101 and a second protrusion 104 that extends substantially perpendicularly from the other end of the main body portion 101, as illustrated in FIG. 3. As discussed below, the first protrusion 102 is part of the interengaging structure of the link 76 that cooperates with the interengaging structure of the lower contact arm 72. The link 76 also includes a mounting structure 106 that is configured to be operatively connected to a mounting structure 108 at one end of the upper contact arm 70 via the pin 78 and ring 80, as more clearly illustrated in FIG. 7. A protrusion 110 extends from the mounting structure 106 and is substantially parallel to and spaced from the elongated main body portion 101 of the link 76. The upper contact arm 70 includes an extension 112, and the biasing member 82 is positioned between the extension 112 of the upper contact arm 70 and the protrusion 110 of the mounting structure 106 of the link 76, as illustrated in FIGS. 5 and 6. The spring 84 is positioned between one end of the first elongated portion 90 of the lower contact arm 72 and the second protrusion 104 of the link 76.

The biasing member 82 is configured to bias the link 76 to the first orientation in which the protrusion 102 of the link 76 is received by the recess 94 of the lower contact arm 72, thereby interconnecting the lower contact arm 72 to the link 76, and operatively connecting the lower contact arm 72 to the upper contact arm 70. As illustrated in FIG. 5, when the protrusion 102 of the link 76 is received by the recess 94 of the lower contact arm 72, the bias of the spring 84 forces the lower contact arm 72 downward, which causes the protrusion 102 to engage the first surface 96 of the recess 94. When the contact trip foot 74 is pressed against the work piece, the lower contact arm 72 moves upward relative to the nose piece assembly 44 and causes the lower contact arm 72 to initially move slightly relative to the link 76, which causes the second surface 98 to engage the protrusion 102, as illustrated in FIG. 6.

Further movement of the lower contact arm 72 causes the link 76 and the upper contact arm 70 to move against the bias of the spring 66 located at the other end of the upper contact arm 70, and allows interaction between the upper contact arm 70 and the trigger 50 for actuation of the trigger valve assembly 22 so that the fastener driver 40 drives a fastener out of the drive track 42 and into the work piece. When the fastener driving device 10 is lifted off of the work piece, the bias of the spring 66 causes the contact trip assembly 52 to move downward relative to the nose piece assembly 44, and back to the position illustrated in FIG. 5.

Figure 8:
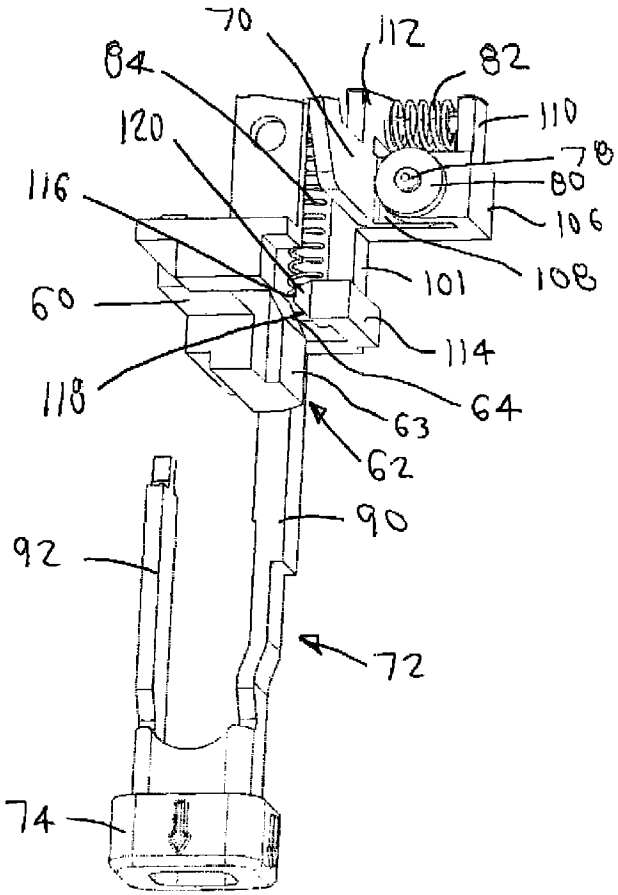
FIG. 8 illustrates a portion of the contact trip assembly and a portion of the pusher assembly as the contact trip assembly moves from the actuated position of FIG. 6 to the non-actuated position.
Figure 9:
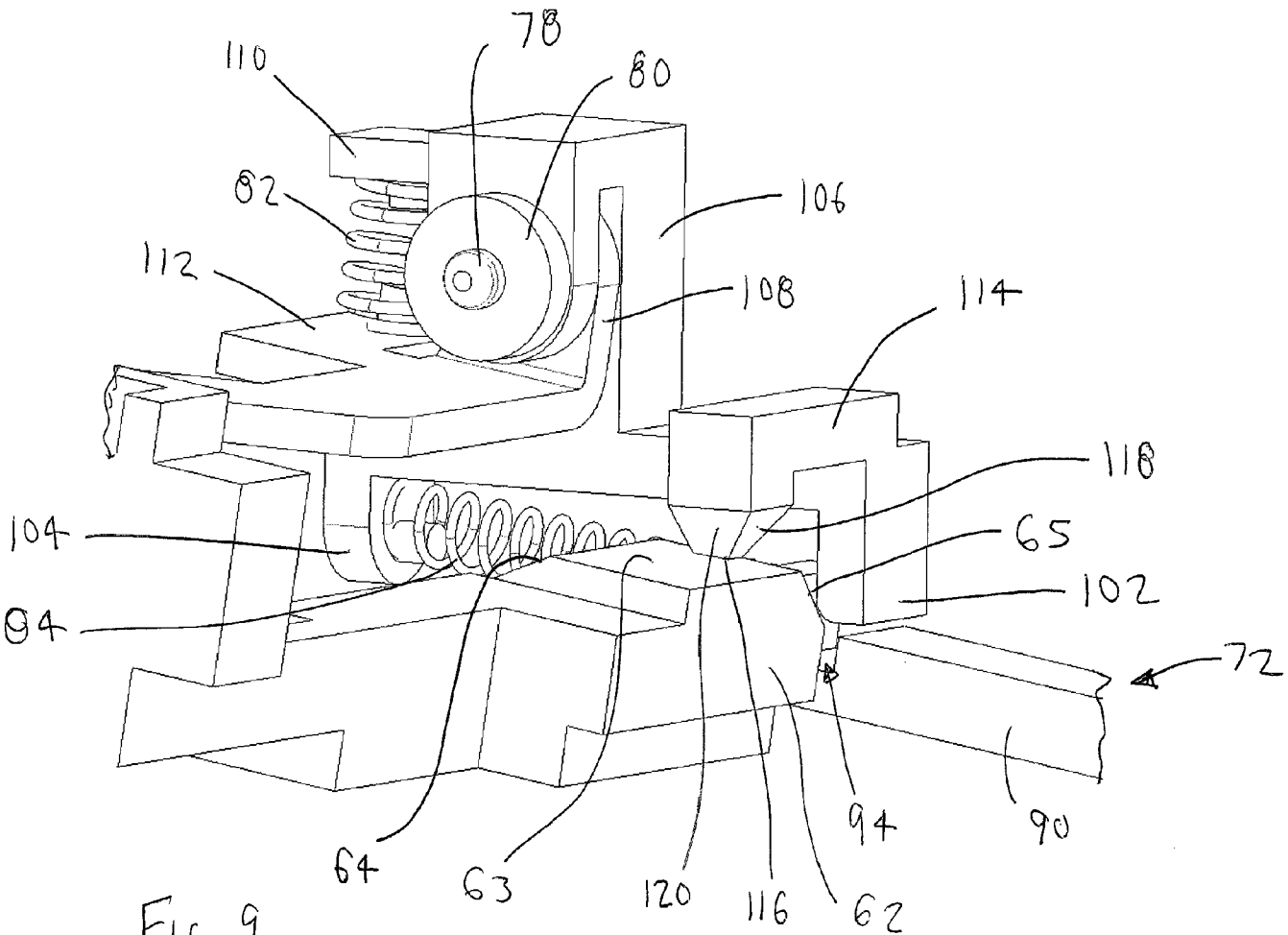
FIG. 9 illustrates a portion of the contact trip assembly and a portion of the pusher assembly when the contact trip assembly is in a dry fire lockout position.
Figure 10:
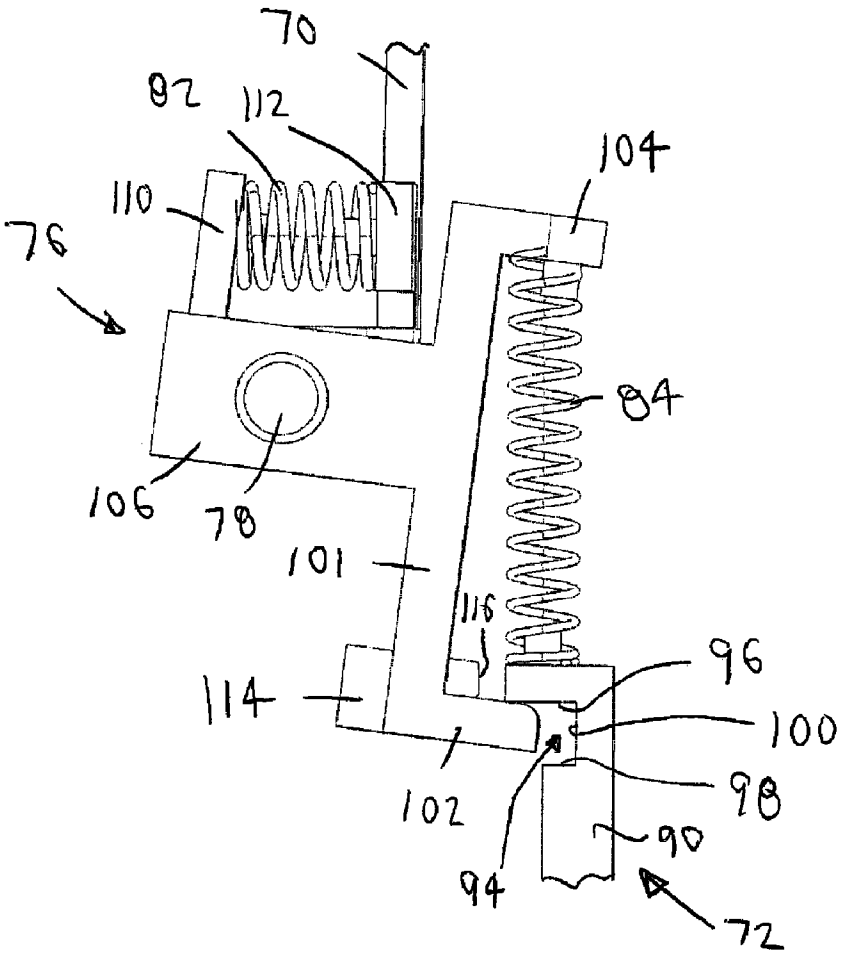
FIG. 10 illustrates a portion of the contact trip assembly when the contact trip assembly is in a dry fire lockout condition.

A dry fire lockout portion 114 of the link 76 extends from the end of the link 76 that includes the protrusion 102 at an angle substantially perpendicular to the elongated body portion 101 of the link 76. As illustrated in FIGS. 8 and 9, the dry fire lockout portion 114 of the link 76 includes a first surface 116, a second surface 118 that is oriented at an angle (i.e., is ramped) with respect to the first surface 116 and generally faces the contact trip foot 74, and a third surface 120 that is oriented at an angle (i.e. is ramped) with respect to the first surface 116 and generally faces the pusher assembly 54. The first surface 116, the second surface 118, and the third surface 120 of the dry fire lockout portion 114 of the link 76 are configured to engage the first surface 63, the second surface 64, and the third surface 65 of the dry fire lockout portion 62 of the lifter 60, respectively. The dry fire lockout portion 62 of the lifter 60 and the dry fire lockout portion 114 of the link 76 are configured so that when the first surface 116 of the dry fire lockout portion 114 of the link 76 is engaged with the first surface 63 of the dry fire lockout portion 62 of the lifter 60, the protrusion 102 of the link 76 is no longer in the recess 94 of the first elongated portion 90 of the lower contact arm 72, as illustrated in FIGS. 9 and 10, and discussed in further detail below.

Figure 7:
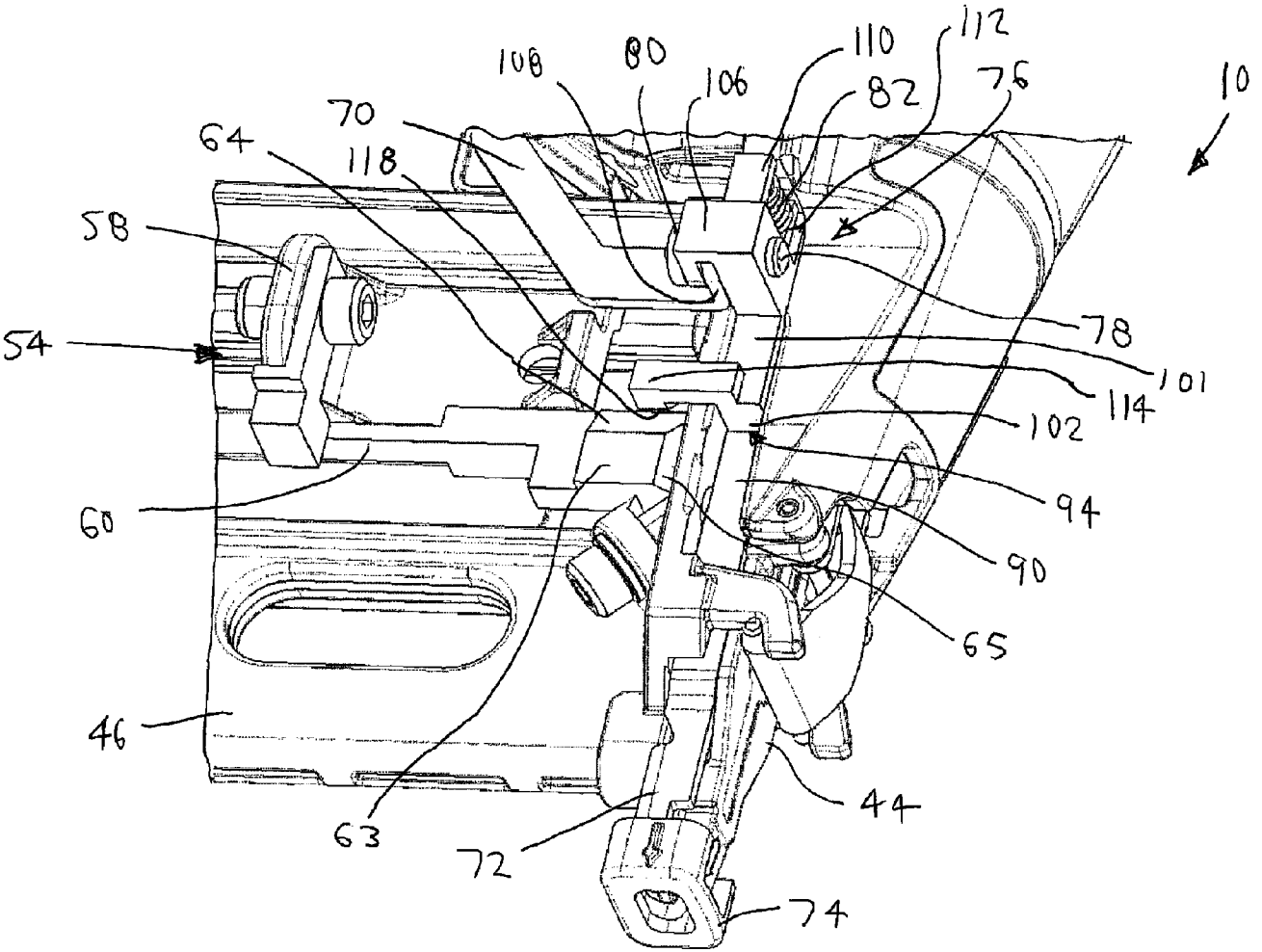
FIG. 7 illustrates the portion of the fastener driving device of FIG. 4 when the number of fasteners of the supply of fasteners is less than a predetermined number and the contact trip assembly is in the actuated position of FIG. 6.

During operation of the fastener driving device 10 where there is an adequate supply of fasteners in the magazine 46, the protrusion 102 of the link 76 will remain engaged with the recess 94 of the lower contact arm 72 due to the biasing force provided by the biasing member 82. As the supply of fasteners is depleted, the pusher assembly 54, including the lifter 60, moves towards the drive track 42. FIG. 7 illustrates the condition of the fastener driving device 10 when the contact trip assembly has been actuated by pressing the contact trip foot 74 against the work piece, and the number of fasteners in the magazine 46 has fallen below a predetermined level for the first time, the predetermined level below which the dry fire lockout device is designed to be activated. The predetermined level may be one, two, three, or more fasteners.

As illustrated in FIGS. 7 and 8, in this condition of the fastener driving device 10, the second surface 64 of the dry fire lockout portion 62 of the lifter 60 and the second surface 118 of the dry fire lockout portion 114 of the link 76 of the contact trip assembly face one another, and begin to engage one another as the fastener driving device 10 is lifted off of the work piece. Because the second surface 64 of the dry fire lockout portion 62 of the lifter 60 and the second surface 118 of the dry fire lockout portion 114 of the link 76 are angled to complement each other, the second surface 118 is able to slide along the second surface 64 as the contact trip assembly 52 moves to its non-actuated condition, until the first surface 116 of the dry fire lockout portion 114 of the link 76 engages the first surface 63 of the dry fire lockout portion 62 of the lifter 60, as illustrated in FIG. 9.

Movement of the dry fire lockout portion 114 of the link 76 along the second surface 64 to the first surface 63 of the dry fire lockout portion 62 of the lifter 60 causes movement of the link 76 (e.g., rotation or pivoting) about the pin 78 relative to the upper contact arm 70 against the bias of the biasing member 82 to a second orientation. Such movement (e.g., rotation or pivoting) causes the first protrusion 102 of the link 76 to move out of the recess 94 of the lower contact arm 72, as illustrated in FIGS. 9 and 10. In other words, interaction between the dry fire lockout portion 62 of the lifter 60 and the dry fire contact portion 114 of the link 76 allows the lifter to lift the first protrusion 102 of the link 76 out of the recess 94 of the lower contact arm 72, as more clearly illustrated in FIG. 10. As also illustrated in FIG. 10, the protrusion 102 maintains contact with a portion of the first surface 96 that is outside of the recess 94. This allows the lower contact arm 72 to remain operatively connected to the link 76 so that the lower contact arm 72 does not move away from the upper contact arm 70.

Figure 11:
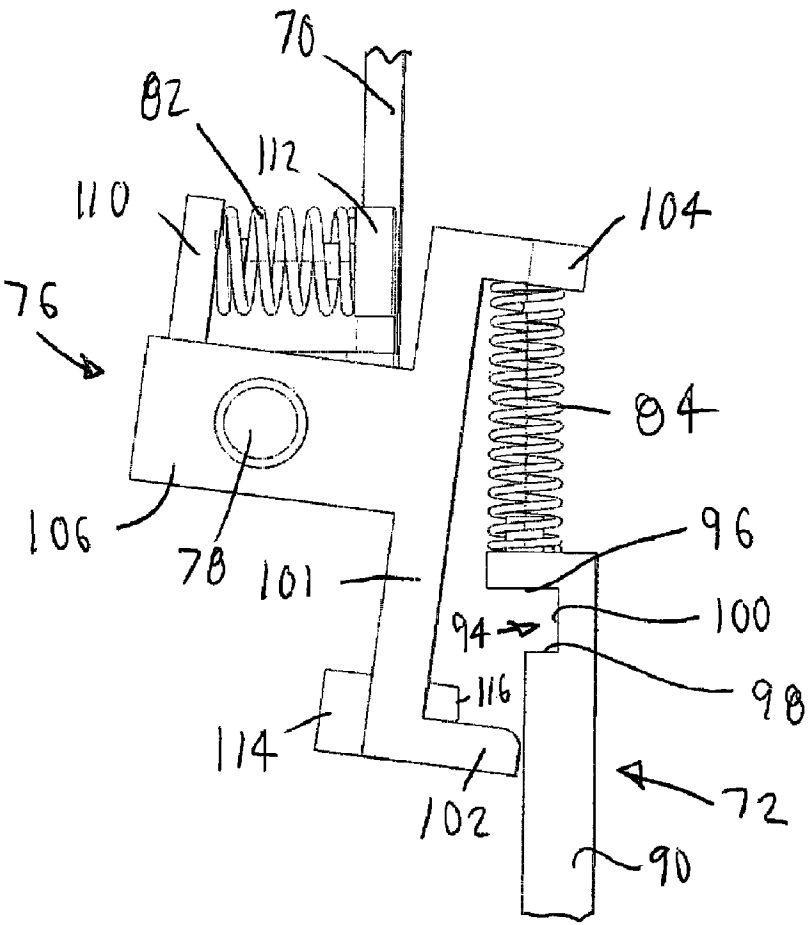
FIG. 11 illustrates the portion of the contact trip assembly of FIG. 10 when a portion of the contact trip assembly is actuated while the contact trip assembly is in the dry fire lockout condition.

While the dry fire lockout portion 114 of the link 76 and the dry fire lockout portion 62 of the lifter 60 are engaged, as illustrated in FIG. 9, and the protrusion 102 of the link 76 is not engaged with the recess 74 of the lower contact arm 72, as illustrated in FIG. 10, if the lower contact arm 72 is moved in a direction towards the spring 84 and the second protrusion 104 of the link 76, as illustrated in FIG. 11, the movement will not cause the upper contact arm 70 to move enough to interact with the trigger 50. This is because the resistance (i.e. spring constant) of the spring 84 is less than the resistance (i.e. spring constant) of the spring 66 located between the upper contact arm 70 and the housing assembly 14. When the lower contact arm 72 is moved towards the second protrusion 104 of the link 76, the spring 84 will compress before the spring 66, and the upper contact arm 70 will not move towards the trigger 50 by enough of a distance, if at all, to allow actuation of the trigger valve assembly 22, even if the trigger 50 is actuated.

Thus, even though the fastener driving device 10 is in a dry fire lockout condition when the first surface 116 of the dry fire lockout portion 114 of the link 76 of the contact trip assembly 52 and the first surface 63 of the dry fire lockout portion 62 of the lifter 60 of the pusher assembly 54 are engaged, the dry fire lockout condition may be bypassed for the lower contact arm 72 by allowing the lower contact arm 72 to move relative to the link 76 and the upper contact arm 70. This bypass feature may allow potential damage to the lower contact arm 72 in the event the device is accidentally dropped to be reduced, as compared to an arrangement where the lower contact arm is locked in place when the device is in the dry fire lockout condition.

Figure 12:
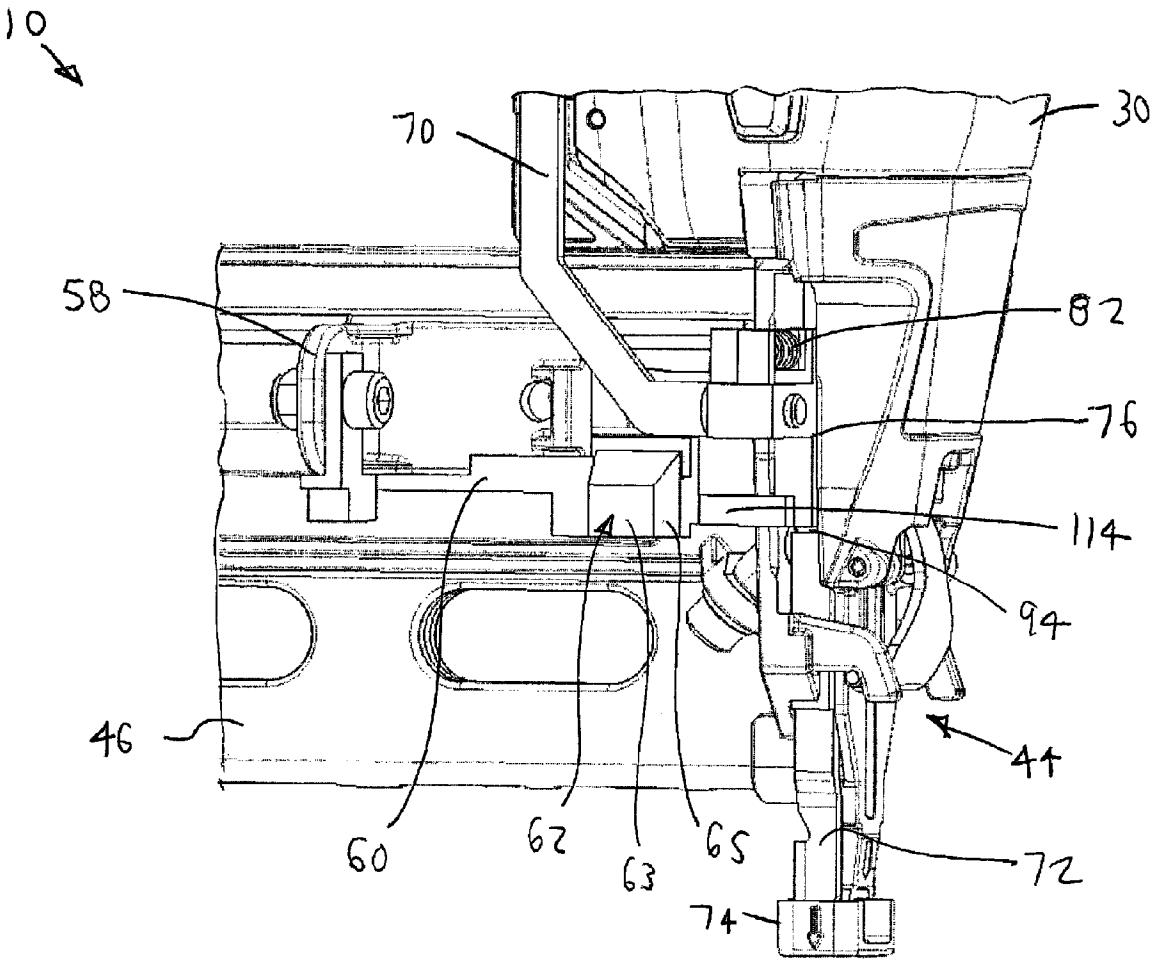
FIG. 12 illustrates a portion of the fastener driving device when there are no fasteners in the magazine and the pusher assembly is released by a user of the fastener driving device.
Figure 13:
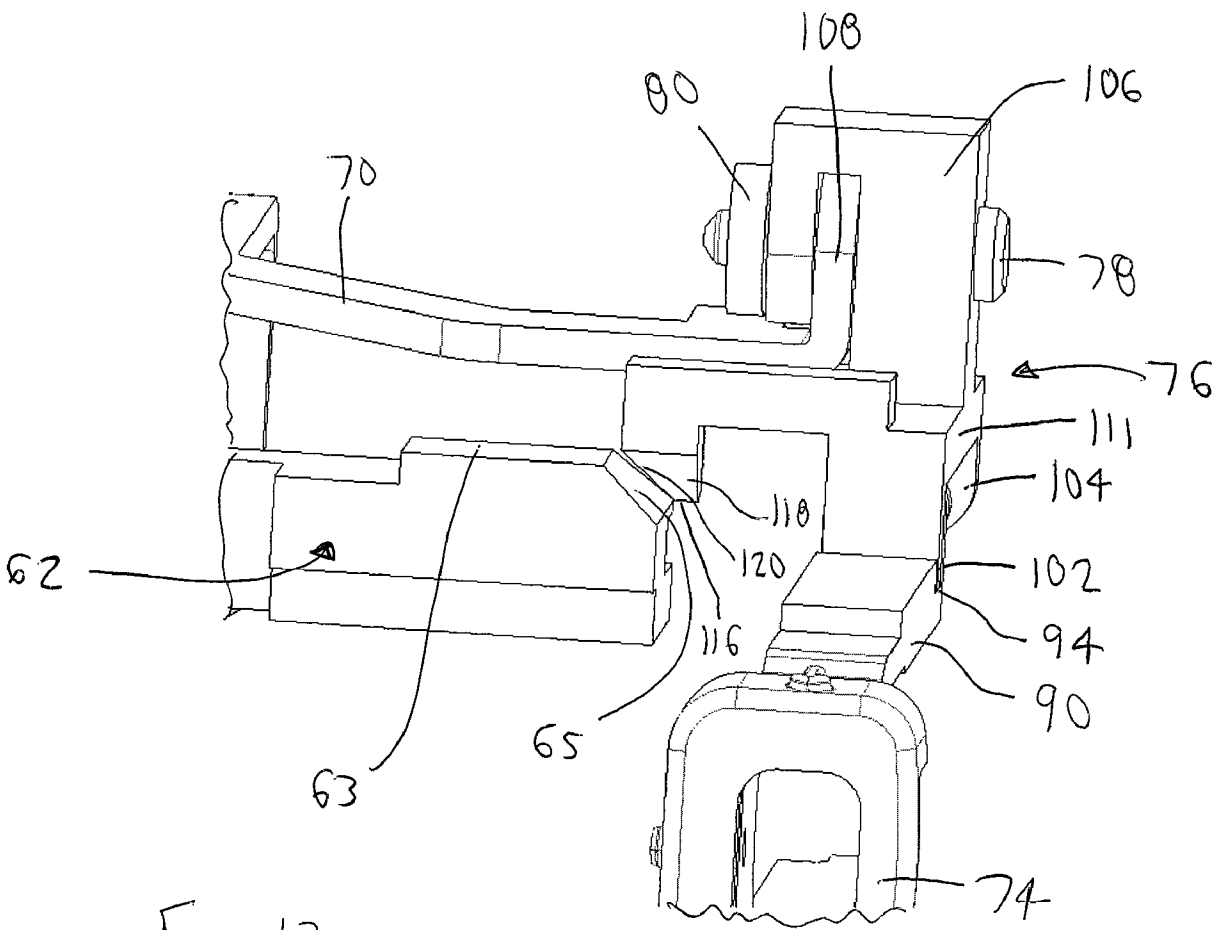
FIG. 13 illustrates a portion of the contact trip assembly and a portion of the pusher assembly when the pusher assembly reaches the contact trip assembly after the pusher assembly is released by user as illustrated in FIG. 12.

FIG. 12 illustrates a condition of the fastener driving device 10 when there are less than the predetermined number of fasteners, e.g. no fasteners, in the magazine 46 and the pusher assembly 54 has been moved in a direction away from the nose piece assembly 44 so that the dry fire lockout device has been disengaged. As illustrated, the first surface 116 of the dry fire lockout portion 114 of the link 76 of the contact trip assembly 52 is no longer engaged with the first surface 63 of the dry fire lockout portion 62 of the lifter 60 of the pusher assembly 54. If the pusher assembly 54 is released from this position and additional fasteners have not been loaded into the magazine 46, the pusher assembly 54 will move towards the nose piece assembly 44 under the bias of the biasing member, and the third surface 65 of the dry fire lockout portion 62 of the lifter 60 will engage the third surface 120 of the dry fire lockout portion 114 of the link 76, as illustrated in FIG. 13.

Figure 14:
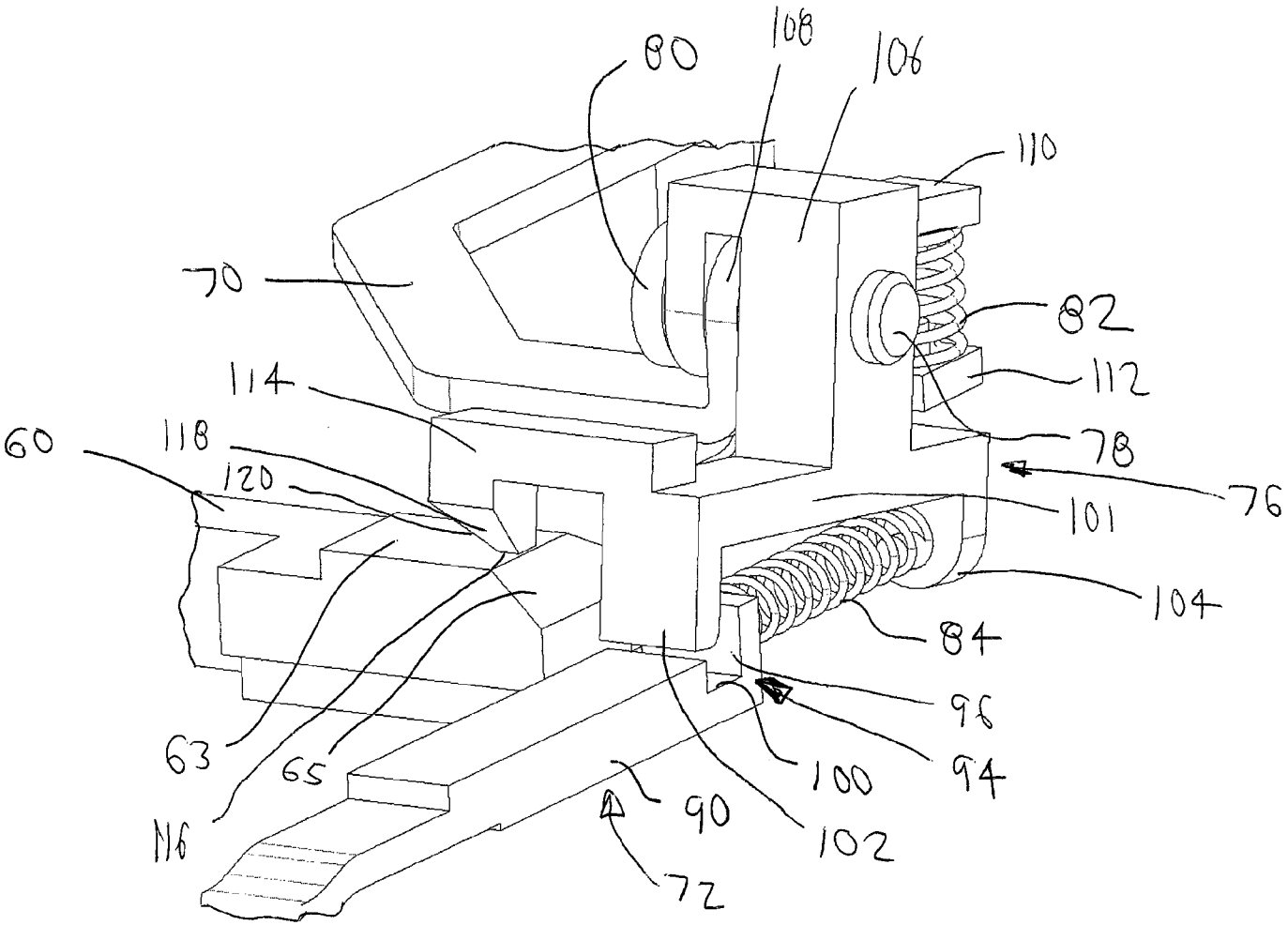
FIG. 14 illustrates a portion of the contact trip assembly and a portion of the pusher assembly when the contact trip assembly is in the dry fire lockout condition after the pusher assembly stops after being released by the user with no fasteners in the magazine.

Due to the complementary angled surfaces of the third surfaces 65, 120, as the pusher assembly 54 continues to move towards the nose piece assembly 44, the lifter 60 will cause the link 76 to rotate or pivot about the pin 78, and the first surface 116 of the dry fire lockout portion 114 of the link 76 will reengage the first surface 63 of the dry fire lockout portion 62 of the lifter 60. As illustrated in FIG. 14, the engagement of the first surfaces 63, 116 locks the link 76 in the second orientation in which the first protrusion 102 of the link 76 is out of the recess 94 of the lower contact arm 72, thereby allowing the lower contact arm 74 to bypass the lockout condition of the rest of the contact trip assembly 52.

Even if the number of fasteners in the supply of fasteners is more than the predetermined level that causes the dry fire lockout assembly 55 to create the dry fire lockout condition, as discussed above, a dry fire lockout condition may still be created by the user of the fastener driving device 10, if desired. For example, if desired, the protrusion 110 of the mounting structure 106 of the link 76 may be pressed by the user against the bias of the biasing member 82 and cause the link 76 to move from the first orientation to the second orientation, thereby moving the first protrusion 102 out of the recess 94 of the lower contact arm 72. This will create the dry fire lockout condition as long as the user presses the protrusion 110 against the bias of the biasing member 82. To return the fastener driving device 10 to its operating condition, with the lower contact arm 72 in its non-actuated position, the user simply releases the protrusion 110 to allow the link 76 to move back to the first orientation and the first protrusion 102 to reengage the recess 94 of the lower contact arm 72.

Figure 16:
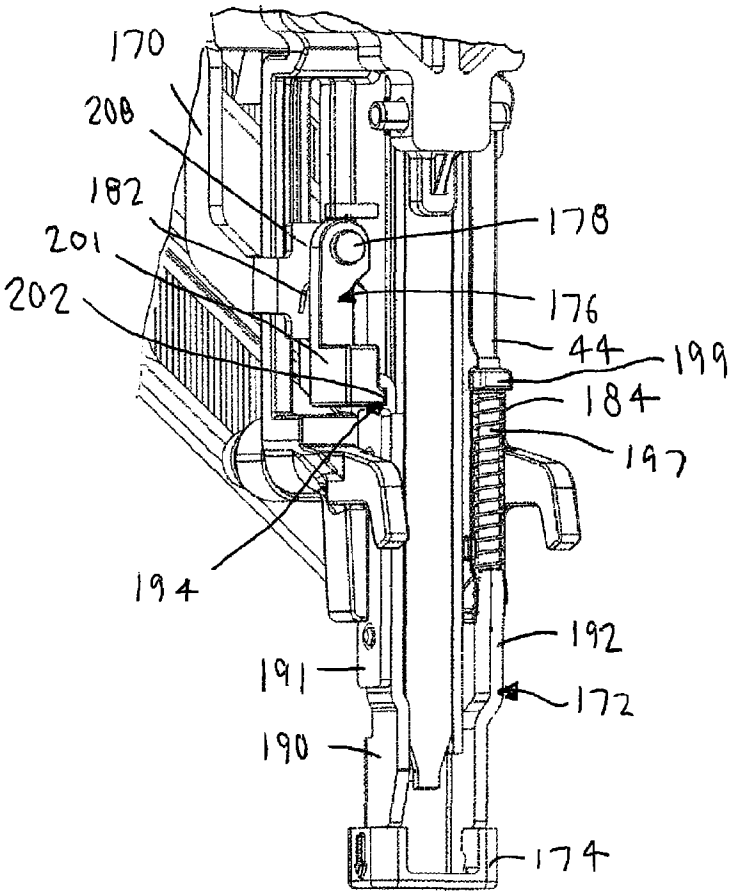
FIG. 16 illustrates another view of the portion of the contact trip assembly of FIG. 15.
Figure 15:
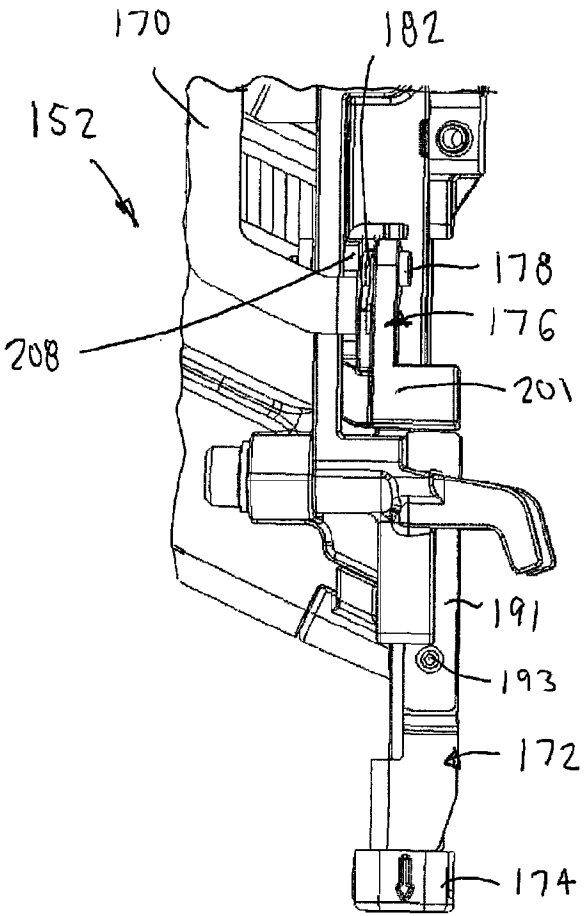
FIG. 15 illustrates a portion of a contact trip assembly of the fastener driving device of FIG. 1 according to an embodiment of the invention when the contact trip assembly is in a non-actuated position.

FIGS. 15-19 illustrate a contact trip assembly 152 in accordance with an embodiment of the invention. As illustrated in FIGS. 15 and 16, the contact trip assembly 152 generally includes an upper contact arm 170, a lower contact arm 172, and a link 176 that operatively connects the upper contact arm 170 and the lower contact arm 172. The link 176 is pivotally mounted on mounting structure 208 of the upper contact arm 170 by a pin 178 and associated flexible ring (not shown) that is configured to be received by the pin 178. Any suitable connector may be used to pivotally connect the link 176 to the upper contact arm 170. The illustrated embodiment is not intended to be limiting in any way.

As illustrated in FIGS. 15 and 16, a biasing member 182, which in the illustrated embodiment is shown to be a torsion spring, is positioned between the upper contact arm 170 and a portion of the link 176. The biasing member 182 is configured to bias the link 176 in a first orientation in which the link 176 is interconnected with the lower contact arm 172 so that the lower contact arm 172 and the upper contact arm 170 are operatively connected, as discussed in further detail below. As shown in FIG. 16, a spring 184 is positioned between one end of the lower contact arm 172 and the nose piece assembly 44. The function of the spring 184 will be discussed in further detail below.

Figure 17:
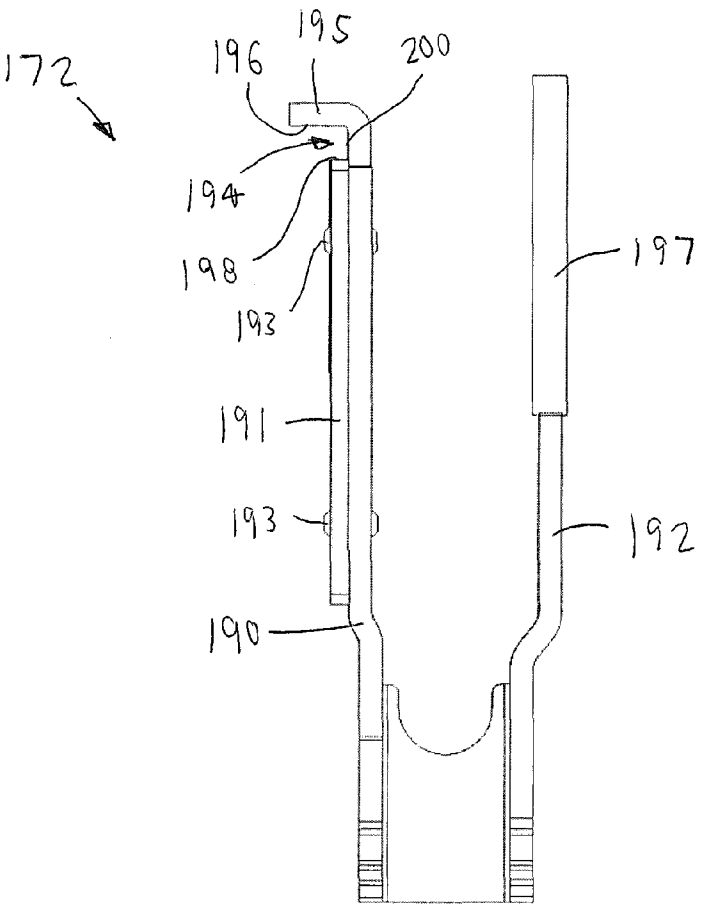
FIG. 17 illustrates a lower contact arm of the contact trip assembly of FIG. 15.

A contact trip foot 174, which is mounted to one end of the lower contact arm 172, is configured to engage the work piece. As illustrated in FIG. 17, the lower contact arm 172 generally includes a first elongated portion 190 and a second elongated portion 192 that extend upwards from the contact trip foot 174. The second elongated portion 192 is configured to be received by a channel in the nose piece assembly 44 and is configured to provide additional stiffness and stability to the lower contact arm 172 during actuation of the contact trip assembly 152.

In order for the link 176 and the lower contact arm 172 to be interconnected when the link 176 is in the first orientation, the link 176 and the lower contact arm 172 have cooperating interengaging structures that are configured to provide an interconnection when the link 176 is in the first orientation, and to not provide an interconnection when the link 176 is moved to a second orientation against the bias of the biasing member 182 via the dry fire lockout device described above. In an embodiment, as part of the interengaging structure for the lower contact arm 172, the first elongated portion 190 of the lower contact arm 172 includes a recess 194 near an end that is opposite the contact trip foot 174. The recess 194 is generally defined by three surfaces, including a first surface 196 that is provided by an end portion 195 of the first elongated portion 190 that is generally perpendicular to the rest of the first elongated portion 190, as illustrated in FIG. 17. The recess is also generally defined by a second surface 198 that is substantially parallel to the first surface 196, and a third surface 200 that is substantially perpendicular to and is positioned between the first surface 196 and the second surface 198. The second surface 198 may be provided by a reinforcement structure 191 that is fastened to the first elongated portion 190 with a plurality of fasteners 193, such as rivets. The third surface 200 may be provided by the first elongated portion 190, as illustrated in FIG. 17.

Figure 19:
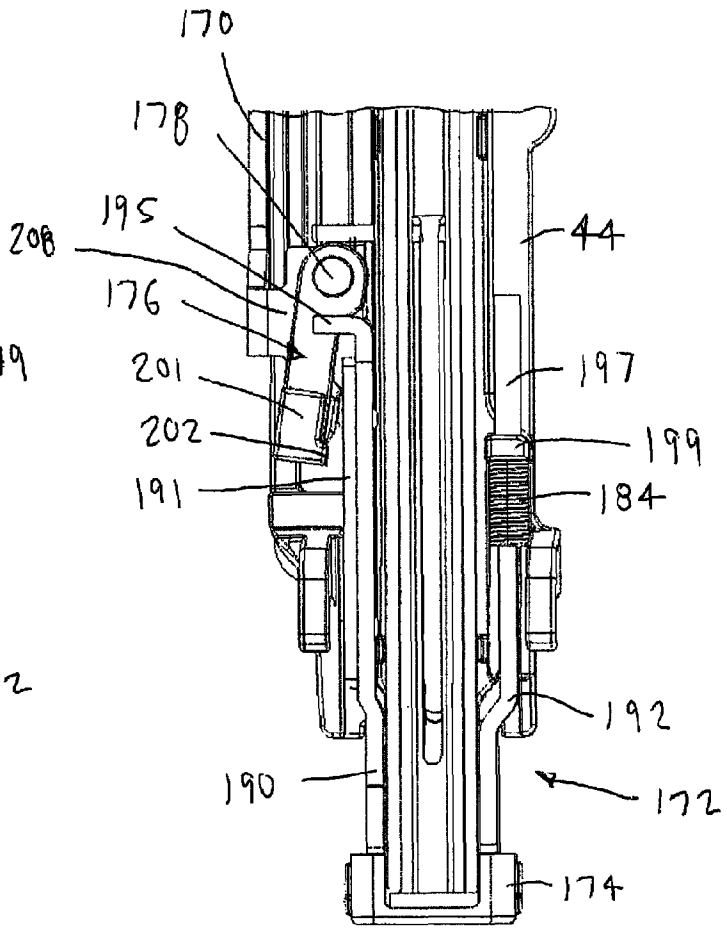
FIG. 19 illustrates the portion of contact trip assembly of FIG. 18 when the contact trip assembly is in an actuated position.
Figure 18:
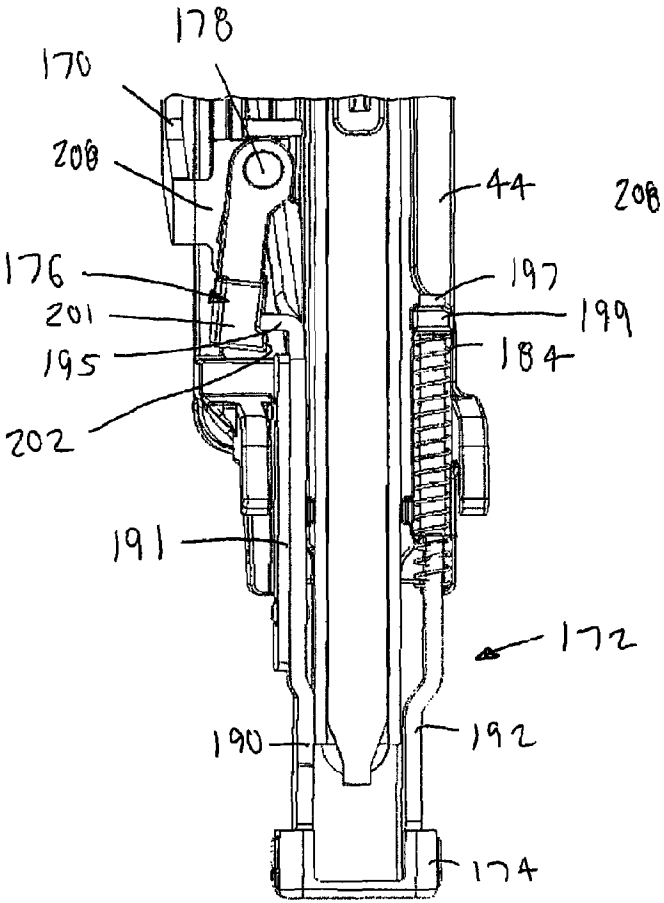
FIG. 18 illustrates the portion of the contact trip assembly of FIG. 15 when the contact trip assembly is in a dry fire lockout condition and the contact trip assembly is in the non-actuated position.

The link 176 includes an elongated main body portion 201 that includes a protrusion 202 that extends substantially perpendicularly from one end of the main body portion 201, as illustrated in FIGS. 16, 18, and 19. The first protrusion 202 is part of the interengaging structure of the link 176 that cooperates with the interengaging structure of the lower contact arm 172.

The spring 184 is positioned on a spring receiving portion 197 of the second elongated portion 192, as illustrated in FIG. 18. With the spring 184 on the spring receiving portion 197 of the second elongated portion 192, the spring receiving portion 197 is fed through a portion 199 of the nose piece assembly 44, so that one end of the spring 184 engages the portion 199 of the nose piece assembly 44 and the opposite end of the spring 184 is held by the second elongated portion 192 of the lower contact arm 172. The spring 184 provides a resistance against movement of the lower contact arm 172 relative to the nose piece assembly 44, and biases the lower contact arm 172 to an extended position.

The biasing member 182 is configured to bias the link 176 to the first orientation in which the protrusion 202 of the link 176 is received by the recess 194 of the lower contact arm 172, thereby interconnecting the lower contact arm 172 to the link 176, and operatively connecting the lower contact arm 172 to the upper contact arm 170. When the contact trip foot 174 is pressed against the work piece, the lower contact arm 172 moves upward relative to the nose piece assembly 44 and causes the lower contact arm 172 to initially move slightly relative to the link 176, which causes the second surface 198 to engage the protrusion 202.

Further movement of the lower contact arm 172 causes the link 176 and the upper contact arm 170 to move against the bias of the spring 66 located at the other end of the upper contact arm 170, and allows interaction between the upper contact arm 170 and the trigger 50 for actuation of the trigger valve assembly 22 so that the fastener driver 40 drives a fastener out of the drive track 42 and into the work piece. When the fastener driving device 10 is lifted off of the work piece, the bias of the spring 66 causes the contact trip assembly 152 to move downward relative to the nose piece assembly 44, and back to the position illustrated in FIGS. 15 and 16.

The link 176 also includes a dry fire lockout portion, which may be the same dry fire lockout portion 114 described above with respect to the link 76. Therefore, details of the dry fire lockout portion of the link 176 will not be described herein. In other words, the dry fire lockout device described above may be used with the contact trip assembly 152 illustrated in FIGS. 15-19 to move the link 176 between the first orientation illustrated in FIGS. 15 and 16 to the second orientation illustrated in FIGS. 18 and 19.

When the dry fire lockout device is engaged, i.e. the dry fire lockout portion 114 of the link 76, 176 and the dry fire lockout portion 62 of the lifter 60 are engaged, the link 176 is in the second orientation, as illustrated by FIG. 18, and the protrusion 202 of the link 176 is not engaged with the recess 174 of the lower contact arm 172. If the lower contact arm 172 is moved in a direction towards the upper contact arm 170 against the bias of the spring 184, as illustrated in FIG. 19, such movement will not cause the upper contact arm 170 to move, which will prevent actuation of the trigger valve assembly 22, because the lower contact arm 172 and the upper contact arm 170 are no longer operatively connected.

Thus, even though the fastener driving device 10 is in a dry fire lockout condition when the dry fire lockout portion 114 of the link 76, 176 of the contact trip assembly 52, 152 and the dry fire lockout portion 62 of the lifter 60 of the pusher assembly 54 are engaged, the dry fire lockout condition may be bypassed for the lower contact arm 172 by allowing the lower contact arm 172 to move relative to the link 176 and the upper contact arm 170. This bypass feature may allow potential damage to the lower contact arm 172 in the event the device is accidentally dropped to be reduced, as compared to an arrangement where the lower contact arm is locked in place when the device is in the dry fire lockout condition.

While specific embodiments of the invention have been described above, it will be appreciated that the invention may be practiced otherwise than as described. The descriptions above are intended to be illustrative, not limiting. Thus, it will be apparent to one skilled in the art that modifications may be made to the invention as described without departing from the scope of the claims set out below.

What is claimed is:

1. A fastener driving device comprising:

a housing having an engine receiving portion;

a drive engine located in the engine receiving portion, the drive engine comprising a cylinder and a piston reciprocally mounted within the cylinder, the piston comprising a driver configured to move along a drive axis to drive a fastener during a drive stroke;

a nose assembly operatively connected to the housing, the nose assembly comprising a drive track aligned with the drive axis;

a magazine constructed and arranged to feed successive leading fasteners from a supply of fasteners into the drive track;

a pusher assembly slidably mounted in the magazine, the pusher assembly comprising a pusher configured to push the supply of fasteners towards the drive track, and a lifter comprising a dry fire lockout portion;

a trigger configured to operate the drive engine;

a contact trip assembly comprising a lower contact arm comprising a first end configured to contact a work piece, an upper contact arm comprising a first end operatively connected to the lower contact arm, and a second end configured to enable the trigger to operate the drive engine, a link movably mounted to the first end of the upper contact arm and interconnected with the lower contact arm when the link is in a first orientation, the link comprising a dry fire lockout portion, and a biasing member positioned between the link and the upper contact arm, the biasing member being configured to bias the link in the first orientation so that the link is interconnected with the lower contact arm to operatively connect the link and the lower contact arm;

wherein the dry fire lockout portion of the lifter is configured to engage the dry fire lockout portion of the link, when the supply of fasteners is less than a predetermined number of fasteners, and move the link against the bias of the biasing member to a second orientation in which the link is not interconnected with the lower contact arm.

2. The fastener driving device according to claim 1, wherein the lower contact arm further comprises a second end and a recess located near the second end, wherein the link comprises a protrusion configured to be received by the recess of the lower contact arm when the link is in the first orientation, and wherein when the link is in the second orientation, the protrusion is not received by the recess.

3. The fastener driving device according claim 2, wherein the contact trip assembly further comprises:

a spring positioned between the second end of the lower contact arm and a nose piece assembly of the fastener driving device, wherein the spring is configured to provide resistance against movement of the lower contact arm relative to the upper contact arm when the link is in the second orientation.

4. The fastener driving device according to claim 1, wherein the biasing member comprises a torsion spring.

5. The fastener driving device according to claim 1, wherein the dry fire lockout portion of the lifter comprises a first ramped surface configured to engage a first ramped surface of the dry fire lockout portion of the link when the contact arm assembly is moved from an actuated position to a non-actuated position and the number of fasteners in the supply of fasteners is less than the predetermined number, and lift the dry fire lockout portion of the link so that the link is moved from the first orientation to the second orientation.

6. The fastener driving device according to claim 5, wherein the dry fire lockout portion of the lifter comprises a second ramped surface configured to engage a second ramped surface of the dry fire lockout portion of the link when the contact arm assembly is in the non-actuated position, the number of fasteners in the supply of fasteners is less than the predetermined number, and the pusher assembly is moved towards the nose assembly, and lift the dry fire lockout portion of the link so that the link is moved from the first orientation to the second orientation.

7. The fastener driving device according to claim 1, wherein the link is located outside of the housing and the nose assembly.

8. A dry fire lockout assembly for a fastener driving device, the dry fire lockout assembly comprising:

a lifter comprising a dry fire lockout portion; and a contact trip assembly comprising a lower contact arm comprising a first end configured to contact a work piece, an upper contact arm comprising a first end operatively connected to the lower contact arm, and a second end configured to enable a trigger to operate a drive engine of the fastener driving device, a link movably mounted to the first end of the upper contact arm and interconnected with the lower contact arm when the link is in a first orientation, the link comprising a dry fire lockout portion, and a biasing member positioned between the link and the upper contact arm, the biasing member being configured to bias the link in the first orientation so that the link is interconnected with the lower contact arm to operatively connect the link and the lower contact arm;

wherein the dry fire lockout portion of the lifter is configured to engage the dry fire lockout portion of the link, when a supply of fasteners in a magazine of the fastener driving device is less than a predetermined number of fasteners, and move the link against the bias of the biasing member to a second orientation in which the link is not interconnected with the lower contact arm.

9. The dry fire lockout assembly according to claim 8, wherein the lower contact arm further comprises a second end and a recess located near the second end, wherein the link comprises a protrusion configured to be received by the recess of the lower contact arm when the link is in the first orientation, and wherein when the link is in the second orientation, the protrusion is not received by the recess.

10. The dry fire lockout assembly according to claim 9, wherein the contact trip assembly further comprises:

a spring positioned between the second end of the lower contact arm and a nose piece assembly of the fastener driving device, wherein the spring is configured to provide resistance against movement of the lower contact arm relative to the upper contact arm when the link is in the second orientation.

11. The dry fire lockout assembly according to claim 8, wherein the biasing member comprises a torsion spring.

12. The dry fire lockout assembly according to claim 8, wherein the dry fire lockout portion of the lifter comprises a first ramped surface configured to engage a first ramped surface of the dry fire lockout portion of the link when the contact arm assembly is moved from an actuated position to a non-actuated position and the number of fasteners in the supply of fasteners is less than the predetermined number, and lift the dry fire lockout portion of the link so that the link is moved from the first orientation to the second orientation.

13. The dry fire lockout assembly according to claim 12, wherein the dry fire lockout portion of the lifter comprises a second ramped surface configured to engage a second ramped surface of the dry fire lockout portion of the link when the contact arm assembly is in the non-actuated position, the number of fasteners in the supply of fasteners is less than the predetermined number, and the pusher assembly is moved towards a nose assembly of the fastener driving device, and lift the dry fire lockout portion of the link so that the link is moved from the first orientation to the second orientation.

14. The dry fire lockout assembly according to claim 8, wherein the lifter is part of a pusher assembly slidably mounted in the magazine of the fastener driving device.

* * * * *